United States Patent [19]

Feng et al.

[11] Patent Number: 4,944,656

[45] Date of Patent: Jul. 31, 1990

[54] TELESCOPIC ROD MEANS HAVING ROTATABLY RETRACTABLE DISPLAY SHEET

[76] Inventors: Ou-Yang Feng; Ou-Yang C. Ho, both of P.O. Box 10160, Taipei, Taiwan

[21] Appl. No.: 302,665

[22] Filed: Jan. 27, 1989

[51] Int. Cl.[5] ..... G09F 17/00

[52] U.S. Cl. ..... 116/173; 116/283; 403/13; 403/166

[58] Field of Search ..... 116/173, 281, 283, 209; 40/317, 334, 610, 586; 135/22, 24, 20 M; 248/188.5; 403/13, 14, 109, 166

[56] References Cited

U.S. PATENT DOCUMENTS

| | | | |
|---|---|---|---|
| 1,305,885 | 6/1919 | Coe | 116/173 |
| 1,312,426 | 8/1919 | Schmidt | 116/173 |
| 2,441,875 | 5/1948 | Faber | 116/173 |
| 4,800,834 | 1/1989 | Feng | 116/173 |

FOREIGN PATENT DOCUMENTS

| | | | |
|---|---|---|---|
| 66881 | 10/1957 | France | 40/334 |

*Primary Examiner*—William A. Cuchlinski, Jr.
*Assistant Examiner*—W. Morris Worth

[57] ABSTRACT

A telescopic rod includes a hollow handle having a longitudinal slit formed in the handle, an alignment coupler slidably engageable in said hollow handle having a truncated tube section formed in the coupler having an upper inclined surface formed on the tube section, and a reel pole secured with a display sheet such as a flag cloth having a lower portion of the pole rotatably held in the coupler having a lower inclined surface tapered downwardly and tangentially engageable with the upper inclined surface of the coupler, so that upon a depression of the pole and sheet, the pole will be rotated for a tangential engagement of the two inclined surfaces to align the display sheet with the slit of the handle for a quicker retraction of the sheet into the handle.

7 Claims, 3 Drawing Sheets

TELESCOPIC ROD MEANS HAVING ROTATABLY RETRACTABLE DISPLAY SHEET

BACKGROUND OF THE INVENTION

A telescopic rod means with rolling display sheet had been previously filed by one of the present inventions assigned with a Ser. No. 07/801,685 filed on 08/05/87 and granted as U.S. Pat. No. 4,600,834 issued on Jan. 31, 1989, which however has the following shortcoming:

The telescopic rod means as shown in FIGS. 1–4 of the prior art (U.S. patent appln. Ser. No. 07/081,685) is extended upwardly to engage the key extension 31 of the reel pole 3 with the recess 24 formed in the coupler 2. However, after a long time useage, the extension 31 may be loosened and disengaged from the recess 24 and if the pole is uncarefully rotated to unalign the display sheet 4 from the longitudinal slit 11, the pole 3 must then be rotated to align the sheet 4 with the slit 11 to cause an inconvenient retraction of the sheet into the hollow handle 1.

The present inventors have found the shortcoming of the prior patent and invented the present telescopic rod means having a display sheet rotatably aligned with a slit in the handle so that the display sheet can be quickly retracted into the handle.

SUMMARY OF THE INVENTION

The object of the present invention is to provide a telescopic rod means including a pole fixed with a display sheet having a lower inclined-surface portion rotatably engageable with an upper inclined surface formed in an alignment coupler slidably held in a hollow handle, whereby upon a depression of the pole into the hollow handle, the display sheet on the pole will be rotated to align the sheet with a longitudinal slit formed in the hollow handle for a quicker retraction of the display sheet and the pole into the handle for the winding of the sheet into the hollow handle.

DETAILED DESCRIPTION

Figures 1, 2:
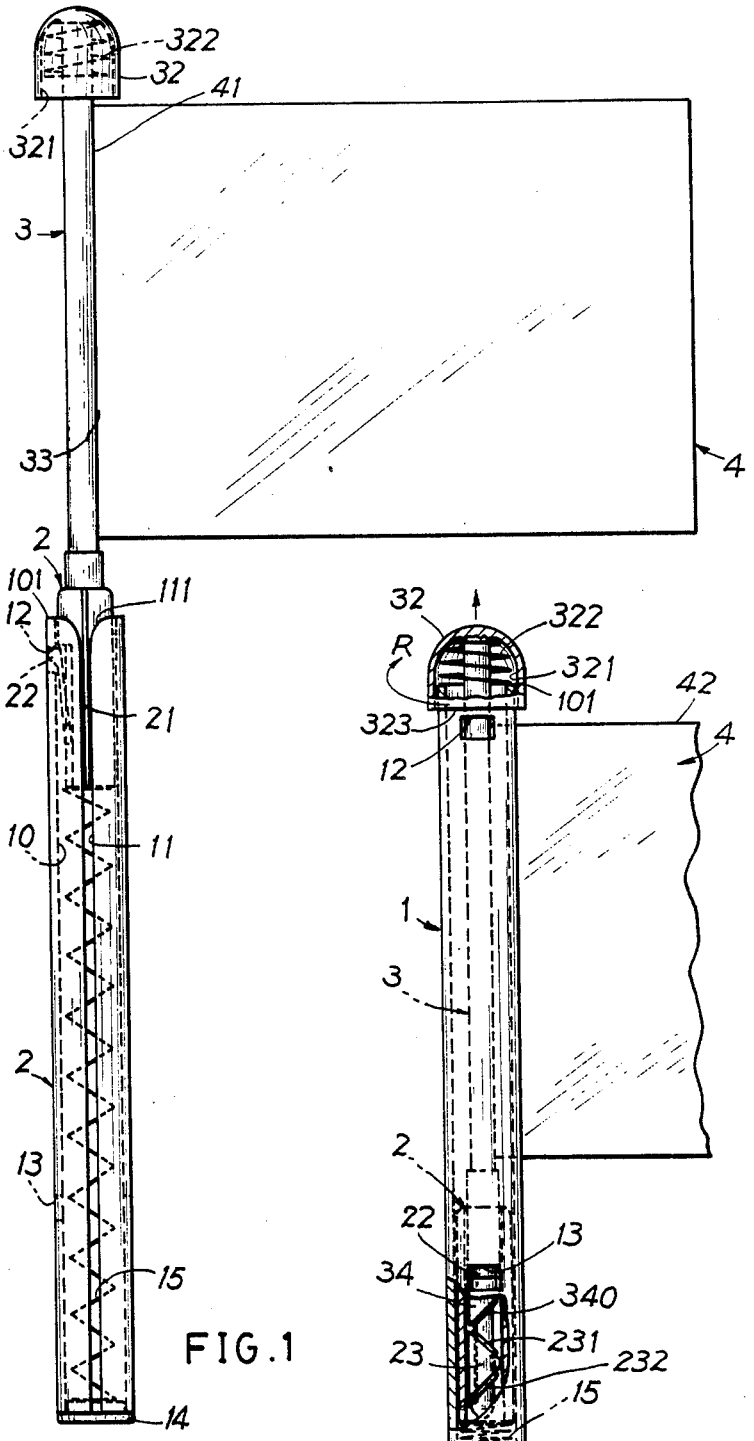
FIG. 1 is an illustration of the present invention as extended.
FIG. 2 is an illustration of the present invention when retracted.

As shown in FIGS. 1–5, the present invention comprises: a hollow handle 1, an alignment coupler 2, a reel pole 3 and a display sheet 4, selected from a flag cloth, a flexible cloth or paper.

The hollow handle 1 is formed with a longitudinal slit 11 as cut from its top edge 101 having an enlarged port 111 formed on a top opening of the slit 11, a longitudinal cylindrical hole 10 in the handle 1, an upper side window 12 formed on the upper portion of the handle, a lower side window 13 formed on a lower portion of the handle, a bottom cap 14 sealing a bottom hole of the handle and a helical spring 15 retained in the cap 14 resiliently tensioning the coupler 2 upwardly. The upper side window 12 is projectively aligned with the lower side window 13.

The alignment coupler 2 generally formed as a cylindrical sleeve includes: an inner through hole 20 formed in the coupler 2 shaped as a cylindrical sleeve held in the hole 10 of the handle 1, a longitudinal extension 21 formed on the coupler slidably engageable with the longitudinal slit 11 in the handle 1, a spring hook plate 22 secured to a lower portion of the coupler and slightly protruding outwardly for operatively engaging the upper side window 12 of the handle 1, and a truncated tube section 23 fixed in a middle portion inside the inner hole 20 having an upper inclined surface 231 tapered upwardly and a lower inclined surface 232 tapered downwardly and having a longitudinal section of the tube section 23 generally shaped as a trapezoid, The upper end portion of the lower inclined surface 232 is formed with a notch 233 therein. The tube section 23 is formed with a central through hole 230 therein.

Figure 4:
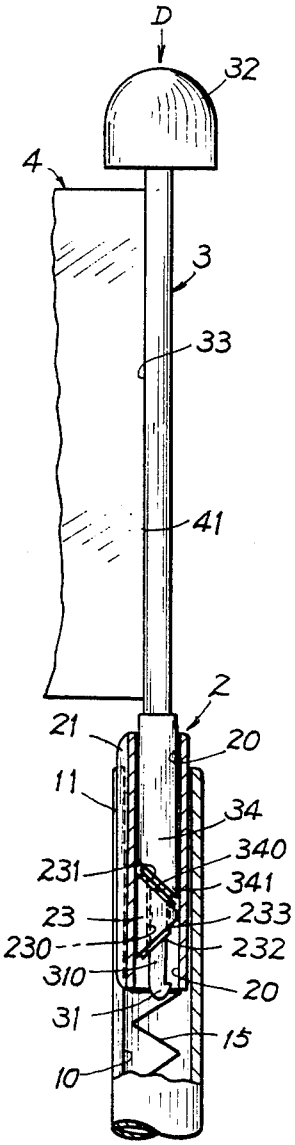
FIG. 4 shows a second step for retracting the pole and sheet from FIG. 3.
Figure 5:
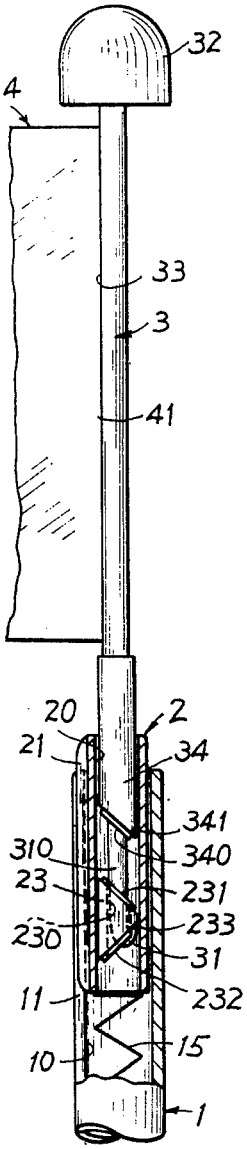
FIG. 5 shows an extending movement of the pole and sheet of the present invention.

The reel pole 3 includes: a top knob 32 formed on a top end of the pole 3, a longitudinal aperture 33 longitudinally formed in the pole 3 for fixing an inner side edge 41 of the display sheet 4, a lower portion 34 rotatably engageable in the inner hole 20 of the coupler 2 having a lower inclined surface 340 tapered downwardly to form a tip portion 341, and a tail rod 310 protruding downwardly from the lower portion 34 through the hole 230 of the coupler 2 having an end hook portion 31 formed on a bottom end of the rod 310 slidably moved along the lower inclined surface 232. The lower inclined surface 340 of the pole 3 is tangentially engageable with the upper inclined surface 231 of the truncated tube section 23 of the coupler 2 as shown in FIG. 4. The end hook portion 31 may be snugly engaged with the notch 233 formed in the tube section 23 of the coupler as shown in FIG. 5. The knob 32 is formed with an annular 321 between a central pole 3 and a cylindrical cap of the knob circumferentially disposed around the pole. A coil spring 322 is jacketed on the pole 3 to be retained in the socket 321.

Figure 3:
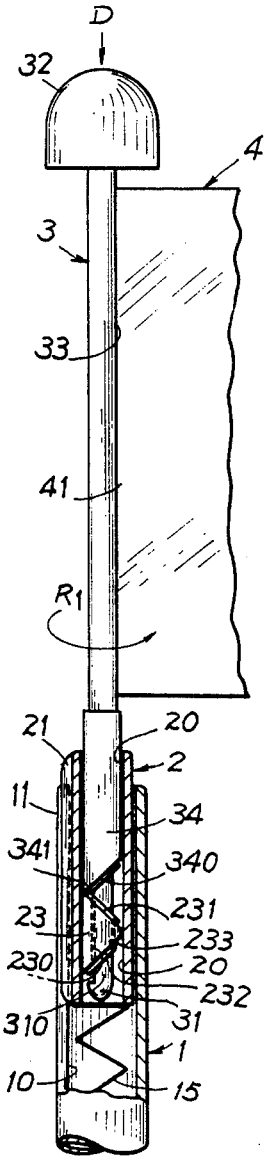
FIG. 3 shows a first step for retracting the pole and sheet into the handle of the present invention.

When retracting the pole 3 and sheet 4 as shown in FIG. 1 into the hollow handle 1, the top knob 32 is downwardly depressed (D) as shown in FIG. 3 to slide the tip portion 341 of the lower portion 34 along the upper inclined surface 231 of the tube section 23 of the coupler 2 so as to rotate the pole 3 and sheet 4 in direction R1 from FIG. 3 towards FIG. 4, thereby tangentially engaging the lower inclined surface 340 of the pole 3 with the upper inclined surface 231 of coupler 2 and aligning the display sheet 4 (especially the inner side edge 41) with the longitudinal slit 11 as shown in FIG. 4 for a smooth retraction of the sheet 4 and pole 3 into the hole 10 of hollow handle 1.

When retracting an extended pole 3 with the display sheet 4 into the handle 1, the coupler 2 is downwardly moved (since the tub section 23 of the coupler 2 is slidably thrusted downwardly by the lower portion 34 of the pole 3), until the spring hook plate 22 of the coupler 2 engaging the lower side window 13 of the handle 1, thereby locking the coupler 2 on a lower portion of the handle 1 and positioning the pole 3 in the hollow handle whereby the display sheet 4 protrudes outwardly through the longitudinal slit 11. The knob 32 is then rotated in direction R as shown in FIG. 2 to wind the sheet 4 around the pole 3 within the hollow handle for portable or storing purposes.

The annular socket 321 of the knob 32 is adapted for rotatably receiving the top edge 101 of the handle 1 as shown in FIG. 2. The spring 322 retained in the knob 32 may help restore the pole 3 slightly upwardly to raise the lower inclined-surface portion 34 beyond the tube section 23 as a cut-away illustration shown in FIG. 2 for a smooth winding operation of the sheet 4 on pole 3. Since a lower periphery 323 of the knob 32 rotatably confines an upper edge 42 of the sheet 4, the sheet 4 will be smoothly wound into the handle 1.

When it is intended to extend the display sheet 4 upwardly from FIG. 2 to FIG. 1, the spring hook plate 22 is depressed inwardly through the lower window 13 and the spring 15 will restore the coupler 2 and the pole 3 upwardly until the hook plate 22 engaging with the upper side window 12, thereby extending the pole 3 and sheet 4 upwardly and outwardly for display, ornamental or advertising purposes. The lower inclined surface 232 may also be made as a flat surface.

Figure 7A:
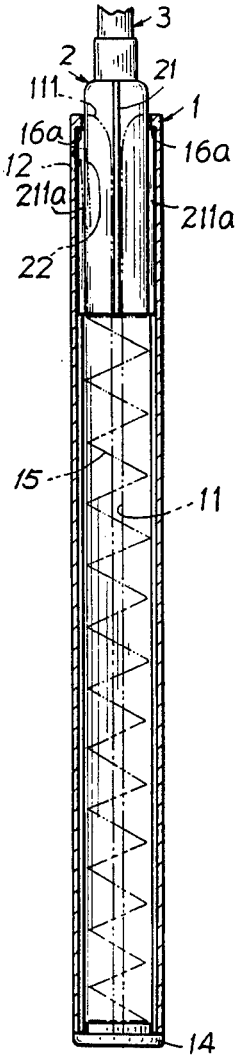
FIG. 7 is a cross sectional drawing as viewed from FIG. 6.
Figure 6:
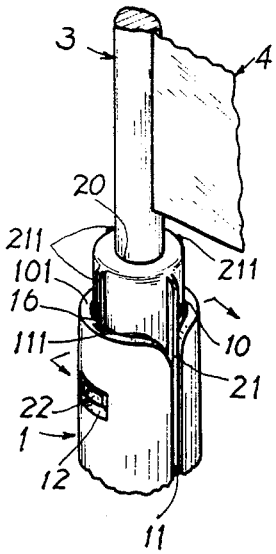
FIG. 6 shows an extended coupler in accordance with the present invention.
Figure 7:
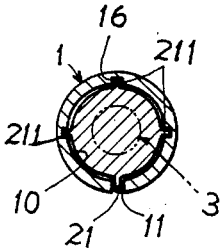

As shown in FIGS. 6, 7, the outer circumferential surface of the coupler 2 may be further formed with plural longitudinal extensions 211, each extension 211 having a height lower than that of the extension 21, respectively engaging with plural longitudinal grooves 16 formed inside the handle 1. Such extensions 211 and grooves 16 may prevent the display sheet 4 from being nibbed in between the coupler 2 and the handle 1.

As shown in FIG. 7*a*, the coupler hook plate 22, the spring 15, and the side windows 12, 13 for preventing the escape of the coupler from the handle may be combined with plural extensions 211*a* engaged and limited in plural grooves 16*a* having uppermost ends formed within the top edge 101 also for preventing the escape of the coupler 2 from the handle 1.

Figure 8:
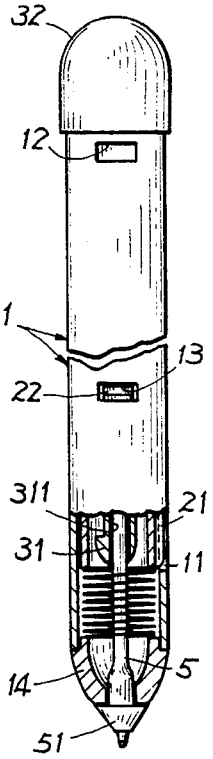
FIG. 8 shows another preferred embodiment of the present invention.

In FIG. 8, a writing instrument 5 such as a pencil lead or an inner ink reservoir of a ball-point pen is fixed inside a central through hole 311 formed in the end hook portion 31 and in the pole 3 having the nib portion 51 secured in the bottom cap 14, thereby further furnishing a writing use for this invention.

The present invention is improved over the prior patented telescopic rod means with the following advantages:

1. Just depressing the knob 32 donwardly, the pole 3 with sheet 4 will be rotated to automatically align the sheet 4 with the slit 11 of handle 1 by matching the lower inclined surface 340 of pole 3 with the upper inclined surface 231 of the coupler 2 as shown in FIG. 4 for a quick smooth retraction of the pole and sheet into the hollow handle.

2. The knob 32 is provided with annular socket 321 for rotatably receiving the top edge 101 of the handle 1 to confine the display sheet for a smooth winding of the sheet around the pole.

3. The end hook portion 31 of the pole 3 can be rotated to engage the notch 233 of couple 2 to stably extend the pole 3 for displaying the sheet 4 as shown in FIG. 5 when the coupler 2 is upwardly urged by the spring 15. However, if the end hook portion 31 is not engaged with the notch 233, the lower portion 34 of the pole 3 may still be supported on the tube section 23 to thereby extend the pole 3 and sheet 4 without collapse.

We claim:

1. A telescopic rod means comprising:

a hollow handle having a longitudinal slit formed therein as cut from a top edge of the handle, a longitudinal cylindrical hole formed in the handle, an upper side window formed on an upper portion of the handle, a lower side window formed on a lower portion of the handle and vertically aligned with said upper side window, a bottom cap sealing a bottom hole of the handle, and a helical spring retained inside the bottom cap; an alignment coupler generally formed as a cylindrical sleeve slidably movable inside said longitudinal hole in the handle, said coupler having an inner through hole formed therein, a longitudinal extension formed on the coupler slidably engages the longitudinal slit of said handle, a spring hook plate which is secured to a lower portion of the coupler having a portion which protrudes radially outwardly from the corner for operatively engaging said upper side window or engaging said lower side window of said handle, said coupler further including a truncated tube section fixed to a middle portion of the inner through hole of said coupler having an upper inclined surface tapered upwardly and having a central through hole formed therein said coupler being resiliently biased toward one end of said longitudinal hole of said handle by said helical spring; and a reel pole having a top knob formd on its top end, a display sheet having an inner side edge of the sheet secured within a longitudinal slit formed in said pole, a lower portion of said reel pole having a lower inclined surface tapered downwardly and rotatably engageable with said upper inclined surface of said tube section of said coupler, said reel pole including a tail rod protruding downwardly from said lower inclined-surface portion of said pole and having an end hook portion formed on a bottom end of said tail rod, said tail rod extending through said central through hole of said tube section, said reel pole having its lower portion depressible rotated within the inner through hole in said coupler, whereby initial depression of the top knob toward said handle rotates the lower inclined-surface portion of said pole into tangential engagement with said upper inclined surface of said tube section of said coupler, the pole and the display sheet are thereby rotated to align said display sheet with said longitudinal slit of said handle and further downward depression of the knob causing said spring hook plate to be disengaged from said upper side window and engage said lower side window for a quick retraction of said pole into said hollow handle so that said sheet can be wound around said pole in said handle by rotating said top knob; and upon a depression of said spring hook plate to disengage said hook plate from said lower side window, said helical spring in said handle will restore and extend said coupler and said pole coupled to said coupler upwardly until said spring hook plate engages said upper side window.

2. A telescopic rod means according to claim 1, wherein said truncated tube section of said coupler is formed with a lower inclined surface tapered downwardly having a notch recessed in an upper end portion of said lower inclined surface of said tube section for snugly engaging said end hook portion of said tail rod of said pole when extending said pole upwardly.

3. A telescopic rod means according to claim 1, wherein said top knob of said pole is formed with an annular socket between said pole and a cylindrical cap circumferentially disposed around said pole for rotatably receiving the top edge of said hollow handle when said pole is retracted into said hollow handle, a coil spring being retained in said annular socket for resiliently rotatably engaging said knob with said top edge of said handle.

4. A telescopic rod means according to claim 1, wherein said coupler is further formed with a plurality of longitudinal extensions on its circumferential surface slidably engaging with a plurality of longitudinal grooves formed inside said handle.

5. A telescopic rod means according to claim 4, wherein the spring, spring hook plate and side windows are replaced by at least a longitudinal extension formed on said coupler is engageable with at least a longitudinal groove formed in said handle, said longitudinal groove having its uppermost end confined by the top edge of said handle for limiting said longitudinal extension of said coupler for preventing an escape of said coupler from said handle.

6. A telescopic rod means according to claim 4, wherein at least a longitudinal extension is formed on said coupler, said longitudinal extension having a length equal to that of said coupler and each said extension engageable with a longitudinal groove formed in said handle notched through the top edge of said handle.

7. A telescopic rod means according to claim 1, wherein said reel pole further includes a writing instrument selected from a pencil lead and an inner ink reservoir of a ball-point pen slidably retained in a central hole formed in said tail rod and said pole, having a nib portion of the writing instrument secured to said bottom cap of said hollow handle.

* * * * *